United States Patent [19]

Giampa

[11] 3,944,319

[45] Mar. 16, 1976

[54] ELECTRIC TERMINAL FITTING

[76] Inventor: Anthony J. Giampa, 8163 Rosewood, Los Angeles, Calif. 90048

[22] Filed: Sept. 9, 1974

[21] Appl. No.: 504,319

[52] U.S. Cl. ..... 339/269

[51] Int. Cl.[2] ..... H01R 7/16

[58] Field of Search ..... 339/163, 164, 269, 271, 339/272, 277

[56] References Cited

UNITED STATES PATENTS

| | | | |
|---|---|---|---|
| 873,872 | 12/1907 | Krantz | 339/269 |
| 883,201 | 3/1908 | Johnson | 339/269 |
| 1,241,756 | 10/1917 | Nielsen | 339/271 |
| 1,278,202 | 9/1918 | Pehrsson | 339/277 R |
| 1,847,738 | 3/1932 | Wiegand | 339/271 |
| 1,942,341 | 1/1934 | Mangin | 339/269 |
| 2,973,503 | 2/1961 | Hansen | 339/269 |
| 3,732,524 | 5/1973 | Reed et al. | 339/164 R |

*Primary Examiner*—Joseph H. McGlynn
*Attorney, Agent, or Firm*—Lyon & Lyon

[57] ABSTRACT

An electric terminal fitting intended to be interposed between a terminal plate and a terminal screw of an electrical outlet and hold an end of a conductor wire in place for electrical connection, the fitting including a two prong member fitting opposite sides of a terminal screw, and having wire retainer elements for placing the end of a conductor wire in position for electrical contact with the outlet. The fitting may be arranged to include a cover having an insulation surface which may be folded over the terminal screw to prevent shorting or grounding of the terminal screw. Also, the fitting may be formed of plastic material and maintain an electrical connection directly between the wire and the terminal plate or the terminal screw.

11 Claims, 20 Drawing Figures

ELECTRIC TERMINAL FITTING

BACKGROUND OF THE INVENTION

Conventional electrical outlets to which the prong fittings of extension cords are connected, are mounted in metal outlet boxes, and are provided with a pair of terminal plates which receive screws. In order to connect the terminal plates to the supply line for the outlet box, a short length of insulation is removed from each wire of the supply line, the exposed wire is bent into hook form and inserted between the head of the screw and the terminal plate, whereupon the screw is tightened. In tightening the screw, the turning force exerted by the screw, particularly if the hook end is wrapped in the wrong direction, or if the wire is a multiple stranded wire, can cause the wire hook to spread. Sometimes such spreading is sufficient to cause a ground or short or to make a poor connection. Also sometimes the screw head may project too far and be exposed for engagement with the walls of the outlet box or other object.

SUMMARY OF THE INVENTION

The present invention minimizes the problems associated with electrical outlets and is directed to an electric terminal fitting which is interposed between the screw fitting and the terminal plate bar and is summarized in the following objects:

First, to provide an electric terminal fitting which simplifies the operation of joining an electrical supply wire to an electrical outlet, and insures an improved connection.

Second, to provide an electric terminal fitting which forms a novel guide and retainer means for the supply line wire adapted to receive a short exposed straight length of wire.

Third, to provide an electric terminal fitting as indicated in the preceeding objects, which may include an insulating tab adapted to be folded over the screw head.

Fourth, to provide an electric terminal fitting as indicated in the other objects wherein the guide and retaining means may be effectively embodied in several constructions all providing a dependable connection between the supply line wire and attachment screw.

Fifth, to provide an electric terminal fitting as indicated in the other objects wherein the fitting is formed of plastic material interposed between the terminal plate of the outlet and supply line wire but so arranged as to provide adequate and dependable contact between the supply line wire and the screw head.

Figure 1:
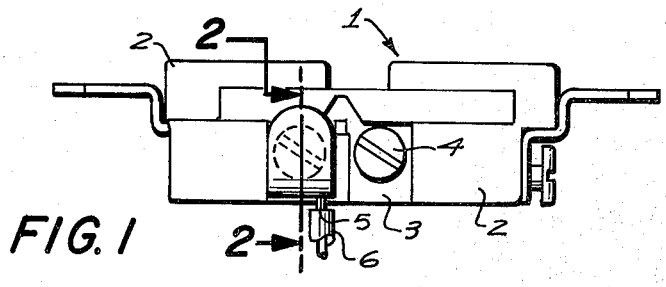
FIG. 1 is a side view of a typical electrical outlet showing one embodiment of the electric terminal fitting in place.
Figures 4, 5:
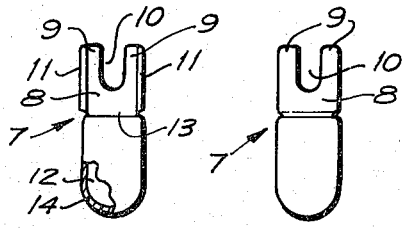
FIG. 4 is a front view of the electric terminal fitting.
FIG. 5 is a back view thereof.

One of the many conventional outlets devices suitable for use with the electrical terminal fitting includes an electric outlet assembly 1 comprising a body of insulation material 2 in which is fitted a pair or more of terminal bars or plates 3 which receive attachment screws 4.

The screws are adapted to secure and make electric contact between the exposed ends of electric wires 5 provided except for the exposed ends with a covering of insulating material 6.

In the practice of the present invention an embodiment of the electric terminal fitting is interposed between the attachment screw 4 and the terminal plate 3. Referring to the embodiment shown in FIGS. 1 through 6, the electric terminal fitting 7 is formed of thin soft sheet metal and includes a base plate 8 forming a pair of flat prongs 9 separated by a slot 10. Bordering the remote margins of the prongs 9 are side flanges 11. Continuing from the end of the plate 8 opposite from the entrance end of the slot 10, is a tab extension 12. The adjacent ends of the plate 8 and extension 12 form a foldable connecting portion 13.

Figure 2:
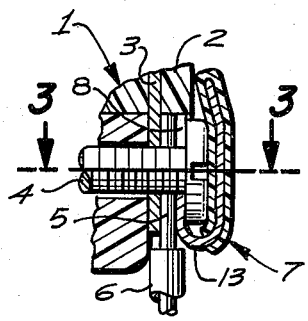
FIG. 2 is an enlarged fragmentary sectional view thereof taken through 2—2 of FIG. 1.
Figure 3:
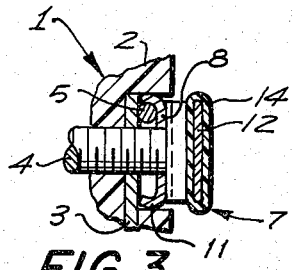
FIG. 3 is another enlarged fragmentary sectional view thereof taken through 3—3 of FIG. 2.
Figure 6:
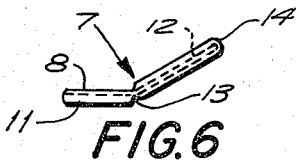
FIG. 6 is a side view thereof.

Operation of the electric terminal fitting is as follows:

The plate 8 of the electric terminal fitting is inserted between the plate 3 and a screw 4. First, however, the insulation is removed from the end of the wire a distance approximately equal to the length of the plate 8. In this regard, it should be noted that the exposed end of the wire is substantially less than the length of exposed wire normally used. Also the wire is not bent, but remains straight. The straight end of the wire is inserted between a corresponding side flange 11 and the shank of the attachment screw 4 as shown in FIGS. 1, 2 and 3. Initially, the tab extension 12 extends from the plate at a slight angle and is adjacent to the wire so that both members may be held together manually while the screw is tightened. Also the tab serves to manipulate the plate into position. In the process of tightening the screw, the flange 11 maintains the wire in place and may be crushed so as to make a good electrical contact between the screw and the wire as well as between the plate 8 and the wire so that the good electrical connection is made ultimately between the wire and the terminal plate 3.

The tab extension 2 may be made of sufficient length so that it may be folded over the head of the screw in which case, the tab is coated with a plastic material having insulation properties as indicated by 14.

Figure 7:
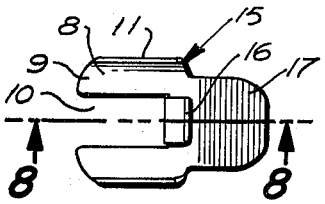
FIG. 7 is a front view showing another embodiment of the electric terminal fitting.
Figure 8:
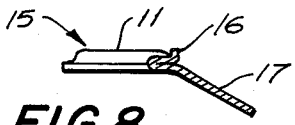
FIG. 8 is a sectional view thereof taken through 8—8 of FIG. 7.

Reference is now directed to FIGS. 7 and 8. In the embodiment here shown, the electric terminal fitting 15 includes elements in common with the first described embodiment and similarly identifies the essential difference being that a folded stop lug 16 is provided at the inner end of the slot 10 and a smaller tab 17 is provided. The tab 17 is not intended to be folded over the head of the screw and is free of insulation. The tab 17 serves principally as a means of manipulating the fitting into place and to aid in holding the fitting in conjunction with the wire in the course of securing the wire in place.

Figure 9:
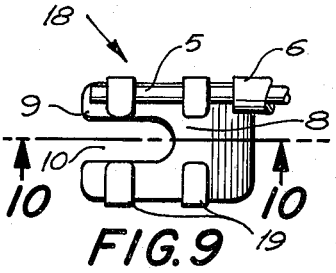
FIG. 9 is a front view of another embodiment of the electric terminal fitting.
Figure 10:
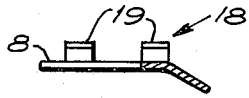
FIG. 10 is a sectional view thereof taken through 10—10 of FIG. 9.

Reference is now directed to FIGS. 9 and 10 which illustrate a further embodiment of the electric terminal fitting designated 18. The portions of the fitting 18 corresponding to the first described embodiment bear similar reference numerals. In place of the side flanges 11, the plate 8 of the fitting 18 is provided with a pair of folded side clips 19 at each side. The clips 19 serve to secure the wires to the fitting 18 both for ease of original installation of the fitting and wires as well as subsequent removal and replacement.

Figure 11:
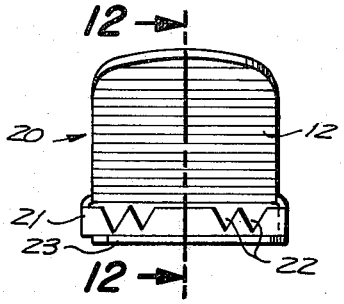
FIG. 11 is an enlarged end view showing a further embodiment of the electric terminal fitting.
Figure 12:
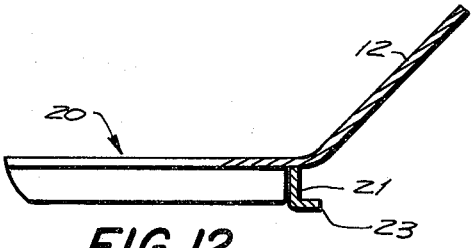
FIG. 12 is a longitudinal sectional view thereof taken through 12—12 of FIG. 11.
Figure 14:
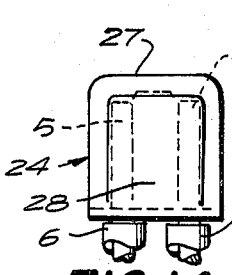
FIG. 14 is a top view of a still further embodiment of the invention showing a pair of wires fitted therein.
Figure 15:
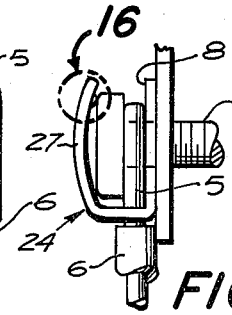
FIG. 15 is a side view thereof showing the terminal plate and attachment screw fragmentarily.
Figure 16:
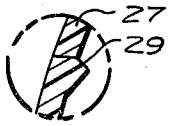
FIG. 16 is an enlarged fragmentary sectional view taken within circle 16 of FIG. 15.
Figure 13:
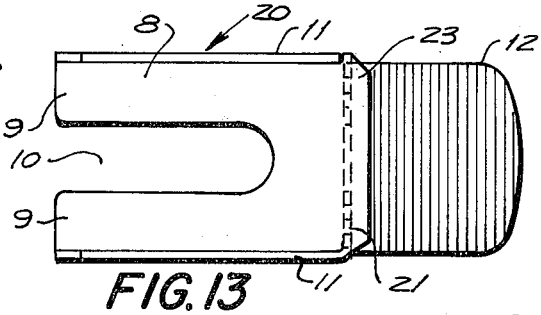
FIG. 13 is a bottom view thereof.
Figure 19:
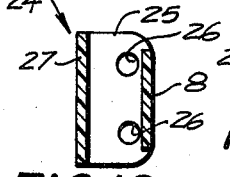
FIG. 19 is a sectional view taken through 19—19 of FIG. 18.
Figure 18:
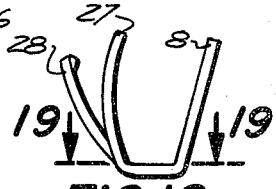
FIG. 18 is a side view thereof before attachment and corresponding to FIG. 15.
Figure 17:
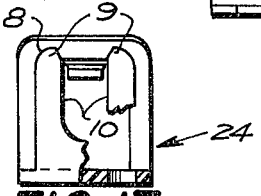
FIG. 17 is a bottom view of the electric terminal fitting taken in the opposite directions from FIG. 14.

Reference is now directed to FIGS. 11, 12 and 13. This embodiment designated 20 of the electric terminal fitting also includes elements common to the first described embodiment and are correspondingly identified. This embodiment differs in that one of the side flanges 11 is provided with an extension 21 which is folded across the plate 8 in the region of the connecting portion 13. The extension 21 is provided with notches 22 through which the ends of several wires 6 may be inserted. More specifically, there may be a pair of notches aligning with the guide passages formed by the flanges 11 and shank of the attachment screw 4 or if it is desired to provide a connection for additional wires, four notches, as shown, may be provided. Also the size of the notches may vary to accommodate specific wire sizes. Still further, the extension 21 may be provided with a reinforcing flange 23. Also if desired, each side flange 11 may be provided with a shortened extension 21 which when folded are disposed in abutting relation.

Figure 20:
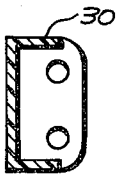
FIG. 20 is a sectional view similar to FIG. 19 but illustrating a modified form of the electrical terminal fitting illustrated in FIGS. 14–19.

Reference is now directed to FIGS. 14 through 19. The embodiment here illustrated may be formed entirely of plastic material having insulation properties. More specifically, this embodiment, designated 24, includes a base plate 8 forming flat prongs 9 divided by a slot 10. In place of the side flanges 11, an end wall 25 is provided having a pair of perforations 26. Joined to the end wall 25 is a top plate element comprised of a top frame 27 and central flap 28 received therein. The frame 27 exposes the screw driver slot in the screw 4 upon opening of the central flap 28 which is releasably held in place by a retaining boss 29. In order to tighten the screw, the flap is opened, then after the wire is secured the flap is closed insulating the head of the screw. Although the plate 8 provides insulation between the wire and the terminal bar or plate 3, ample electric contact is made between the wire and the head of the screw as well as the adjacent portion of the screw shank which in turn is electrically connected to the terminal plate. If desired, the fitting 24 may be constructed without the forked plate 8 whereby the wires are clamped directly between the screw 4 and terminal plate 3 and in such embodiment it is also desirable to provide side flanges 30 to inhibit lateral movement of the wires, all as shown in FIG. 20.

Having fully described my invention it is to be understood that I am not to be limited to the details herein set forth, but that my invention is of the full scope of the appended claims.

I claim:

1. An electric terminal fitting adapted to be interposed between a terminal plate and attaching screw to receive the stripped end of a conductor wire, said fitting comprising:

a. a slotted plate element for receiving the shank of an attaching screw;

b. at least one folded marginal element forming with the screw shank and plate element a guide passage dimensioned to receive an exposed conductor wire; the proportions of the guide passage being such as to clamp the wire upon tightening the screw;

c. and a tab element extending from the plate element and foldable over the head of the screw, the tab element having an insulating surface to guard against electrical contact with the head of the screw.

2. A fitting as defined in claim 1, wherein:

a. a pair of marginal folded elements extend along opposite sides of the plate element.

3. A fitting as defined in claim 1, wherein:

a. a pair of spaced marginal folded elements are provided on each marginal side of the plate element.

4. A fitting as defined in claim 1, wherein:

a. a perforated transverse element is provided at one end of the plate, defining at least one opening axially aligned with the guide passage tangent to the screw for receiving the exposed conductor wire.

5. An electric terminal fitting adapted to be interposed between a terminal plate and an attaching screw to receive the stripped end of a conductor wire, said fitting comprising:

a. a metal plate element having a slot extending therein from one end to receive the shank of the screw;

b. an integral tab element extending from the opposite end to aid in manipulating the plate element into the space between the terminal plate and the head of the screw;

c. opposed folded marginal elements forming with the screw shank a pair of guide passages adapted to receive the exposed straight ends of conductor wires in tangential relation to the screw shank to retain the wire ends in place during tightening of the screw and securing the wire ends;

d. the plate element and tab element being foldably connected and the tab element being of sufficient length as to be folded over the head of the screw;

e. and a covering of insulation on the tab to guard the head of the screw against electrical contact.

6. An electric terminal fitting adapted to be interposed between a terminal plate and an attaching screw to receive the stripped end of a conductor wire, said fitting comprising:

a. a plate element having a slot intersecting one end to receive the shank of the screw;

b. a folded element at a margin of the plate element including means for placing the end portion of the conductor wire for retention and electrical connection between the terminal plate and the wire upon tightening the screw;

c. a tab continuing from the plate element to aid in manipulating the plate element into position, the tab being flexible and dimensioned to fold over the head of screw and includes a surface of insulating material to guard the head from electrical contact.

7. A fitting as defined in claim 6, wherein:

a. the folded element is provided with at least one perforation defining an axis tangent to the shank of the screw for receiving the wire.

8. An electrical fitting adapted for use with an attaching screw of a terminal plate for connecting the stripped end of a conductor wire, comprising a plate element having a portion for receiving the wire in generally parallel relation to the plane of the plate element, the plate element having a frame and releasable flap element for overlying the attaching screw with access through said frame for manipulating the screw, and at least the exterior of said frame and flap being electrically insulated.

9. The fitting of claim 8 wherein flanges extend from the marginal edges of the frame for inhibiting lateral movement of the wire.

10. The fitting of claim 8 wherein said portion for receiving the wire comprises a flange having an opening therethrough for the wire.

11. An electric terminal fitting formed of insulation material and adapted to be interposed between a terminal plate and an attaching screw to receive the stripped end of a conductor wire, said fitting comprising:

a. a plate element having a slot intersecting one end to receive the shank of the screw;

b. a folded element at a margin of the plate element including means for placing the end portion of the conductor wire for retention and electrical connection between the terminal plate and the wire upon tightening the screw;

c. and a screw cover means continuing from the folded element over the head of the screw and including a latachable and flexible central flap to provide access to the screw head and to cover the screw head.

* * * * *